United States Patent [19]

Gamberini et al.

[11] Patent Number: 4,918,901

[45] Date of Patent: Apr. 24, 1990

[54] DEVICE FOR THE INFEED OF DISCRETE STRIPS OF TIN FOIL IN CIGARETTE PACKAGING MACHINERY

[75] Inventors: Antonio Gamberini; Alessandro Minarelli, both of Bologna, Italy

[73] Assignee: G. D. Societa Per Azoni, Italy

[21] Appl. No.: 97,445

[22] Filed: Sep. 16, 1987

[30] Foreign Application Priority Data

Sep. 24, 1986 [IT] Italy ..... 3516 A/86

[51] Int. Cl.[5] ..... B65B 11/30

[52] U.S. Cl. ..... 53/234; 53/389

[58] Field of Search ..... 53/225, 234, 389

[56] References Cited

U.S. PATENT DOCUMENTS

| | | | |
|---|---|---|---|
| 2,952,105 | 9/1960 | Schur | 53/234 X |
| 3,380,227 | 4/1968 | Youngman | 53/234 X |
| 3,926,300 | 12/1975 | Seragnoli et al. . | |
| 3,992,855 | 11/1976 | Palmieri | 53/234 X |
| 4,085,569 | 4/1978 | Seragnoli . | |
| 4,095,396 | 6/1978 | Seragnoli . | |
| 4,358,920 | 11/1982 | Kanai | 53/234 X |
| 4,559,757 | 12/1985 | Focke | 53/234 X |
| 4,646,508 | 3/1987 | Focke | 53/234 |

FOREIGN PATENT DOCUMENTS

| | | |
|---|---|---|
| 247135 | 4/1926 | United Kingdom . |
| 1114708 | 5/1968 | United Kingdom . |
| 1196734 | 7/1970 | United Kingdom . |
| 2068883 | 8/1981 | United Kingdom . |

*Primary Examiner*—John Sipos

[57] ABSTRACT

Incorporated into a conventional cigarette packaging machine, the infeed device serves to position discrete strips of tin foil each of which is subsequently wrapped around a relative bundle of cigarettes at a folding station; the strip of foil and the bundle of cigarettes are transferred toward the folding station together, occupying precise established positions one in relation to the other, by a single rotary indexing unit.

4 Claims, 2 Drawing Sheets

DEVICE FOR THE INFEED OF DISCRETE STRIPS OF TIN FOIL IN CIGARETTE PACKAGING MACHINERY

BACKGROUND OF THE INVENTION

The invention relates to a device for the infeed of discrete strips of tin foil in cigarette packaging machinery.

In conventional cigarette packaging machinery, bundles of cigarettes are formed internally of the single pockets of a conveyor, each bundle normally formed of twenty cigarettes stacked in three layers, and fed in succession to an indexing head generally provided with two slots, each one of which designed to accommodate a relative bundle of cigarettes. Once positioned in a relative slot, each of the single bundles of cigarettes is transferred, by rotation of the indexing head about its own axis, to a folding station at which discrete strips of tin foil arrive in steady succession. The single bunch of cigarettes occupying the folding station is normally ejected from the slot in a radial direction, urged against the relative strip of foil in such a way that foil and cigarettes are transferred, as one, into the peripheral radial pocket of a wrapping wheel, with the foil assuming a U profile and enveloping the bundle of cigarettes as the two are urged into the pocket.

In conventional packaging machinery, infeed of the discrete strips of tin foil to the folding station is accomplished by a cut-and-feed device that operates wholly independently of the indexing head, and will generally incorporate at least one cutting head, which severs the discrete lengths of tin foil from continuous bulk strip, and a plurality of feed rollers that convey the discrete strips toward the folding station.

It has been observed in practical application that certain factors, namely, operation of the feed rollers, channelling and alignment of the discrete strips of tin foil, and above all, timing between infeed of the wrapping strips and arrival of the bundles of cigarettes at the folding station, become increasingly difficult to control as the production tempo of the packaging machinery is stepped up.

SUMMARY OF THE INVENTION

The object of the invention is that of embodying a device for the infeed of discrete strips of tin foil that will ensure faultless control of the position of the single strips during their approach toward the folding station, and will guarantee exact timing between infeed of the strips of tin foil and movement of the corresponding bundles of cigarettes toward the folding station; according to the present invention, such guarantees remain substantially independent of the production tempo of the cigarette packaging machine into which the device happens to be integrated.

The stated object is realized with an infeed device as disclosed, which is designed to handle discrete foil wrappings as utilized in cigarette packaging machinery.

The device comprises indexing means provided with at least one slot designed to accommodate a bundle of cigarettes, supply means which turn out the discrete strips of tin foil, located adjacent to the indexing means, a folding station at which each discrete strip of foil is wrapped around a relative bundle of cigarettes, and feed means that transfer the discrete strips of foil singly and in succession from the supply means to the folding station.

The bundles of cigarettes are transferred singly and in succession by the indexing means from the point of their entry into the slot through to the folding station, and it is an essential feature of the invention that the feed means move as one with the indexing means and incorporate prehensile means, disposed at either side of the slot, which take receipt of each discrete strip of foil and pin it to the outside of the slot during transfer of the slot from the entry point to the folding station.

BRIEF DESCRIPTION OF THE DRAWINGS

The invention will now be described in detail, by way of example, with the aid of the accompanying drawings, in which.

DESCRIPTION OF THE PREFERRED EMBODIMENT

The drawings illustrate a device, denoted 1 in its entirety, for the infeed of discrete strips of tin foil wrapping 2 such as are used in a cigarette packaging machine, denoted 3 in its entirety, for the purpose of enveloping bundles 4 of cigarettes, which normally will be twenty in number and arranged in three layers to constitute a conventional pack (not illustrated).

Figure 2:
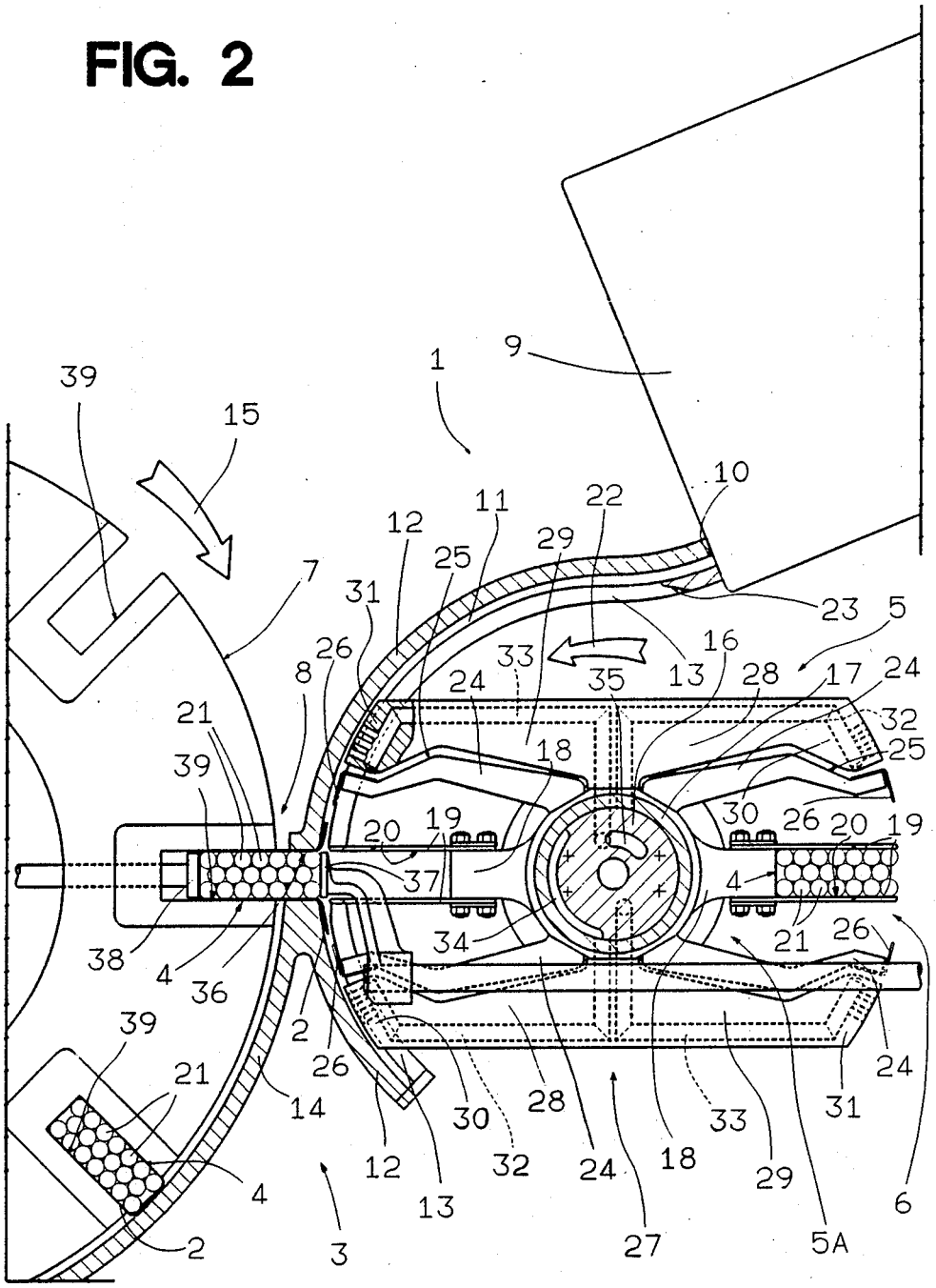
FIG. 2 illustrates the device of FIG. 1 in a further operating position.

The device 1 comprises a rotary indexing unit 5 to which the bundles 4 of cigarettes are supplied singly and in succession by a conventional conveyor (not illustrated) via an entry point denoted 6 (see FIG. 2); each bundle 4 received is transferred to a wrapping wheel 7 by way of a folding station 8, at which the relative strip of foil 2 is made to assume a U profile around the bundle 4 (see FIG. 2) during passage from the indexing unit 5 to the wrapping wheel 7.

The infeed device 1 also comprises a supply unit 9 that turns out the discrete strips of foil 2; any given conventional system might be adopted, such as those designed to cut the requisite discrete length from continuous bulk strip, or to dispense from a stack of prepunched wrappings; for example, such a unit might well be of the type disclosed in U.S. Pat. No. 4,085,569, owned by the applicant.

Figure 1:
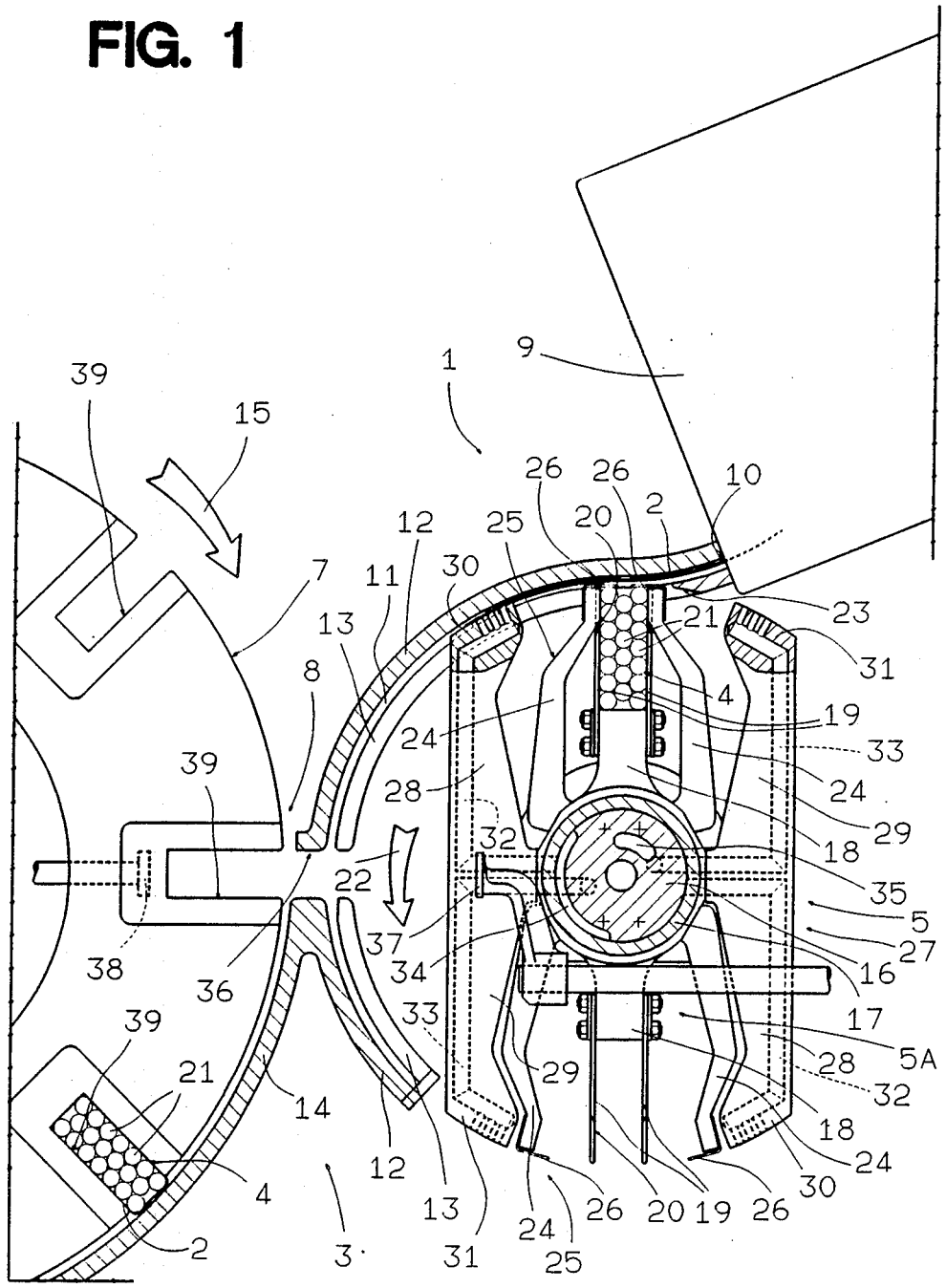
FIG. 1 is the schematic representation of a preferred embodiment of the infeed device disclosed, viewed in side elevation, part cutaway and part block drawing, and illustrated in a first operating position.

It will observed in FIG. 1 that the outlet 10 of the supply unit 9 emerges into one end of a circular path 11 extending toward and through the folding station 8. The path 11 is created by guide means consisting in two cylindrical and coaxially disposed mantles 12 and 13, the first of which is positioned externally of the second and lies substantially tangential in relation to the outer surface of a further cylindrical mantle 14, which is breasted coaxially with the outer surface of the wrapping wheel 7 and occupis a position beyond the folding station 8, considered with respect to the direction in which the wrapping wheel 7 rotates (see arrow 15).

The indexing unit 5 comprises a revolving head 5A substantially as disclosed in U.S. Pat. No. 3,926,300, or as in U.S. Pat. No. 4,095,396, owned by the applicant. The head 5A comprises a fixed shaft 16, disposed coaxially with the two mantles 12 and 13, to which a cylindrical sleeve 17 is journalled.

The sleeve 17 is rotated intermittently by conventional drive means (not illustrated) that index it through 180° around the axis of the shaft 16, and exhibits two appendages 18 that project radially in diametrically opposite directions, each of which carries a respective pair of substantially parallel plates 19. The two plates 19 of each pair extend outward radially from the projecting end of the relative appendage 18, thus creating a radial slot 20 internally of which the bundled cigarettes 21 can be accommodated with their axes parallel to the axis of the shaft 16.

It will be observed in FIG. 1 that the indexing movement occasioned by rotation of the sleeve 17 about the shaft 16 in the direction of the arrow 22, i.e. counter to that of the arrow denoted 15, brings the projecting ends of the paired plates 19 into a chase 23 of circular profile formed in the inner mantle 13, which departs from a point adjacent to the outlet 10 of the unit 9 from which the discrete strips of foil emerge. It will also be observed, from FIG. 2, that the entry point 6 and the folding station 8 are diametrically opposed on either side of the axis of the shaft 16, and that on completion of each step indexed by the sleeve 17, one slot 20 occupies the entry point 6, and the other slot the folding station 8.

24 will be seen to denote the single moving arms of two sets of grippers 25 supported by the sleeve 17 in conventional manner (the details of which are not illustrated); the projecting end of each arm 24 is fitted with a transverse finger 26.

Operated by a conventional mechanism (not illustrated), both sets of grippers 25 are made to assume a spread position (see FIG. 2) whenever the slots 20 are at standstill and occupy the entry point 6 and folding station 8 respectively, whereas one set of grippers 25 is made to draw together (see FIG. 1) during rotation of the sleeve 17. With the grippers 25 drawn together, the outermost radial flank of the relative slot 20 is blanked off by the fingers 26 of the two arms 24.

27 denotes a feed device incorporated into the indexing unit 5, which serves to draw the discrete strips of foil 2 along the path from the outlet 10 of the supply unit 9 round to the folding station 8. Such a feed device 27 comprises two pairs of arms 28 and 29, one for each relative slot 20; these are rigidly associated with the sleeve 17 and extend from it substantially parallel to and at either side of the respective appendages 18. The paired arms 28 and 29 are provided at their projecting ends with prehensile means consisting in relative pneumatic suction pads 30 and 31 that will be spaced apart by a distance less than the length of the discrete strip of tin foil 2. The suction pads 30 and 31 are designed to locate internally of the chase 23 in the inner mantle, and connect with corresponding suction ducts 32 and 33 which are routed along the relative arms 28 and 29.

Considered in relation to the indexing motion of the sleeve 17 (see arrow 22), the arm denoted 28 is the leading arm, and the arm denoted 29 is the trailing arm; the relative ducts 32 and 33 connect via the sleeve 17 with respective suction chambers 34 and 35 located at the shaft 16 and extending around its axis through respective angular distances such as can ensure that suction will be generated through the corresponding pads 30 and 31 from the moment when these enter the chase 23 and are taken up along the circular path 11, until the moment when the relative slot 20 draws to a halt at the folding station 8.

The folding station 8 consists substantially in a radial opening 36 formed in the mantles 12 and 13, and a pusher mechanism 37 designed to impinge upon each bundle 4 brought into the folding station and eject it radially from the slot 20, operating in concert with a radial buffer 38 carried by the wrapping wheel 7; thus, the bundle 4 of cigarettes is urged through the opening 36 and into a relative radial pocket 39 offered by the periphery of the wheel 7, which will be stationary, and aligned with the opening 36 in order to enable acceptance.

Operation of the infeed device 1 will now be described, departing from a position marginally preceding that illustrated in FIG. 1, that is, at the moment in which the cylindrical sleeve 17 (turning in the direction of the arrow 22) brings the leading arm 28 accompanying the slot occupied by a bundle 4 cigarettes to the point where its suction pad 30 enters the top end of the chase 23.

At this juncture, the supply unit 9 will have produced a discrete strip of foil 2 already, and fed it forward such that its leading edge locates in the top end of the chase 23. Depending upon the type of unit 9 in use, the strip 2 may either be stationary, already occupying the position aforementioned on arrival of the arm 28, or it may enter the initial stretch of the chase 23 together with the arm.

With negative pressure generated through the arm 28 as it enters the chase 23, the leading edge of the strip 2 clings fast to the suction pad 30 and is drawn fully out of the unit 9 and transferred along the chase 23 by the feed device 27 at the same speed as the slot 20. During such transfer, the feed device 27 will render the strip 2 stable in relation to the slot 20 by pinning it to the outermost flank of the slot itself, in a position substantially symmetrical thereto; this is accomplished by way of the remaining suction pad 31, to which the trailing edge of the strip 2 will cling just as soon as the relative arm 29 enters the chase 23.

The feed device 27 now draws the strip 2 along the chase 23 to the point where the slot 20 faces the opening 36 (see FIG. 2) and the sleeve 17 ceases rotation. It will be remembered that the feed device turns as one with the sleeve 17, and therefore with the slot 20, so that there is no possibility of any relative movement occurring between the slot 20 and the strip 2; accordingly, on drawing to a halt at the folding station, the strip 2 will be perfectly centered with respect both to the opening 36 and to the slot 20.

With the device 1 thus at a standstill, the arms 24 of the grippers 25 spread apart, the pusher 37 and buffer 38 operate in concert, and the bundle 4 of cigarettes and the strip of foil 2 are urged away through the opening 36. During this movement, the strip 2, which is still anchored at either end to the arms 28 and 29, slides off the suction pads 30 and 31 in exact symmetry with the ejected bundle 4 of cigarettes, gradually assuming a U profile and enveloping the cigarettes as they pass through the opening 36 and into the waiting pocket 39 offered by the wrapping wheel.

At the same time, the slot 20 occupying the entry point 6 at the opposite side of the indexing unit 5 will receive a fresh bundle 4 of cigarettes from the production line conveyor.

Ejection now being accomplished, the pusher 37 is drawn back to an at-rest position, the wrapping wheel 7 indexes through one step to bring the next pocket 39 into alignment with the opening 36, and the sleeve 17 is indexed through 180° to bring the newly-filled slot 20 around to the folding station 8 and the just-emptied slot back to the entry point 6, repeating the cycle thus described.

As may be discerned from the above description, one of the main advantages of the infeed device 1 disclosed over similar conventional types of device consists in the fact that each discrete strip of foil 2 and the relative bundle 4 of cigarettes are indexed together as one item through the final stage of their approach toward the folding station 8, a feature which ensures faultless positioning of each strip in relation to the relative bundle 4, and does so independently, in essense, of the operating speed of the packaging machinery 3 as a whole.

What is claim:

1. A device for the infeed of discrete strips of tin foil in cigarette packaging machinery, comprising:

indexing means provided with at least one slot designed to accommodate a bundle of cigarettes, and designed to transfer bundles of cigarettes singly and in succession from a point of their entry into said slot, to a folding station, said slot having two transversally opposite flanks on said indexing means, said indexing means includes an indexing head which is rotatable about a given axis, said slot comprising radial side walls immovably mounted to and incorporated into said indexing head and opening radially outwards in relation to said axis;

cigarette feeding means for feeding a bundle of cigarettes to said slot;

supply means downstream from said cigarette feeding means in direction of movement of said indexing means which turn out a succession of discrete strips of tin foil for feeding said foil to said indexing means, said supply means being located adjacent to said indexing means;

a folding station at which, in use, each discrete strip of foil is to be wrapped around a corresponding said bundle of cigarettes;

feed means, and means for moving said feed means as one with said indexing means, for transferring said discrete strips of foil singly and in succession from said supply means to said folding station;

two releasable holding means, integral with said feed means and disposed at respective said flanks of said slot, for taking receipt of each discrete strip of foil from said supply means and holding it to said indexing means on both flanks of the slot so that it bridges over the slot and the respective said bundle of cigarettes accommodated therein during transfer of the slot from said point of entry, to said folding station.

2. The device of claim 1, wherein:

said feed means is designed to guide the discrete strips of foil through a substantially circular path from the supply means to the folding station, and said releasable holding means are arranged to rotate as one with the indexing head about said axis, describing a circular trajectory, part of which coincides with said circular path through which the discrete strips of foil are guided.

3. The device of claim 1, wherein:

said releasable holding means comprise two suction pads integral with said indexing head and disposed at respective said flanks of said slot.

4. The device of claim 3 for use in an instance in which each said discrete strip of foil has a uniform predetermined length, wherein:

said two suction pads are set apart one from the other by a distance less than said predetermined length.

* * * * *